US005655887A

United States Patent [19]

Chou

[11] Patent Number: 5,655,887

[45] Date of Patent: Aug. 12, 1997

[54] VALVED PISTON ARRANGEMENT FOR AN ELECTRIC MOTOR DRIVEN AIR COMPRESSOR

[76] Inventor: Wen-San Chou, P.O. Box 82-144, Taipei, Taiwan

[21] Appl. No.: 712,187

[22] Filed: Sep. 11, 1996

[51] Int. Cl.[6] ..... F04B 53/12

[52] U.S. Cl. ..... 417/63; 417/415; 417/553

[58] Field of Search ..... 417/63, 415, 552, 417/553, 569

[56] References Cited

U.S. PATENT DOCUMENTS

| | | | |
|---|---|---|---|
| 1,470,548 | 10/1923 | Spohrer | 417/415 |
| 2,265,971 | 12/1941 | Paul et al. | 417/553 |
| 4,023,467 | 5/1977 | Thurner | 417/552 |
| 4,551,074 | 11/1985 | Asaka et al. | 417/415 |
| 5,215,447 | 6/1993 | Wen | 417/415 |

*Primary Examiner*—Timothy Thorpe

*Assistant Examiner*—Roland G. McAndrews

*Attorney, Agent, or Firm*—Alfred Lei

[57] ABSTRACT

An air compressor including a cylinder, a motor, a reciprocating mechanism coupled to the motor, a compression mechanism reciprocated in the cylinder by the reciprocating mechanism to compress air, the compression mechanism including a base having a coupling bolt, a compressible conical piston holder and a compressible conical piston mounted around the coupling bolt of the base, wherein the coupling bolt of the base is inserted through the center holes of the compressible conical piston holder and compressible conical piston, having a head stopped above the compressible conical piston holder and the compressible conical piston, and a retainer rod raised from the head; a valve flap is slidably mounted around the retainer rod which opens the air passage through the compression mechanism during its down stroke, and close the air passage during its upstroke; a cap is mounted on the retainer rod to limit upward movement of the valve flap relative to the retainer rod.

1 Claim, 5 Drawing Sheets

VALVED PISTON ARRANGEMENT FOR AN ELECTRIC MOTOR DRIVEN AIR COMPRESSOR

BACKGROUND OF THE INVENTION

1. Field of the Invention

This invention relates to air compressors, and relates more particularly to-an improved structure of air compressor which uses two air inlets and one air outlet to achieve high compression ratio.

2. Description of the Prior Art

FIG. 5 shows an air compressor according to the prior art. The air compressor comprises a motor 5, a mounting plate 5, a transmission gear 7, a cylinder 8, and a coupling block 9. The motor 5 is fastened to the mounting plate 6 by screws, having a pinion 50 on the output shaft thereof meshed with the transmission gear 7. The mounting plate 6 has a shaft 60 mounted on the vertical wall thereof. The transmission gear 7 is fixedly mounted around the shaft 60 at one end. A counterweight 61 is fastened to the shaft 60 at an opposite end. The counterweight 61 has a coupling rod 62 at one side coupled to a link 63. The cylinder 8 is mounted on the horizontal wall of the mounting plate 6 to hold a piston 80. The piston 80 is connected. to the link 63. The coupling block 9 is fastened to the top side of the cylinder 8 by screws 81, having an air input chamber 91 and an air inlet 90 for guiding outside air into the air input chamber 91. The air inlet 90 is controlled by a valve block 92, which is supported on a spring 93. The coupling block 9 further comprises an output chamber 94 and a guide tube 95 connected to the output chamber 94. The output chamber 94 is controlled by a valve block 96, which is supported on a spring 97. When the piston 80 is moved downwards by the link 63, outside air is drawn into the cylinder 8. When the piston 80 is moved upwards, the air inlet 90 is closed, and compressed air is driven out of the cylinder 8 through the guide tube 95. This structure of air compressor is functional, however its compression ration is low. Because of low compression ratio, the motor wears quickly with use.

SUMMARY OF THE INVENTION

This invention relates to air compressors, and relates more particularly to an improved structure of air compressor which uses two air inlets and one air outlet to achieve high compression ratio.

It is one object of the present invention to provide an air compressor which achieves high performance. It is another object of the present invention to provide an air compressor which is simple in structure. According to the present invention, the air compressor comprises a cylinder, a motor, a reciprocating mechanism coupled to the motor, a compression mechanism reciprocated in the cylinder by the reciprocating mechanism to compress air, the compression mechanism including a base having a coupling bolt, a compressible conical piston holder and a compressible conical piston mounted around the coupling bolt of the base, wherein the coupling bolt of the base is inserted through the center holes of the compressible conical piston holder and compressible conical piston, having a head stopped above the compressible conical piston holder and the compressible conical piston, and a retainer rod raised from the head; a valve flap is slidably mounted around the retainer rod which open the air passage through the compression mechanism during its down stroke, and close the air passage during its upstroke; a cap is mounted on the retainer rod to limit upward movement of the valve flap relative to the retainer rod.

DETAILED DESCRIPTION OF THE PREFERRED EMBODIMENT

Figure 1:
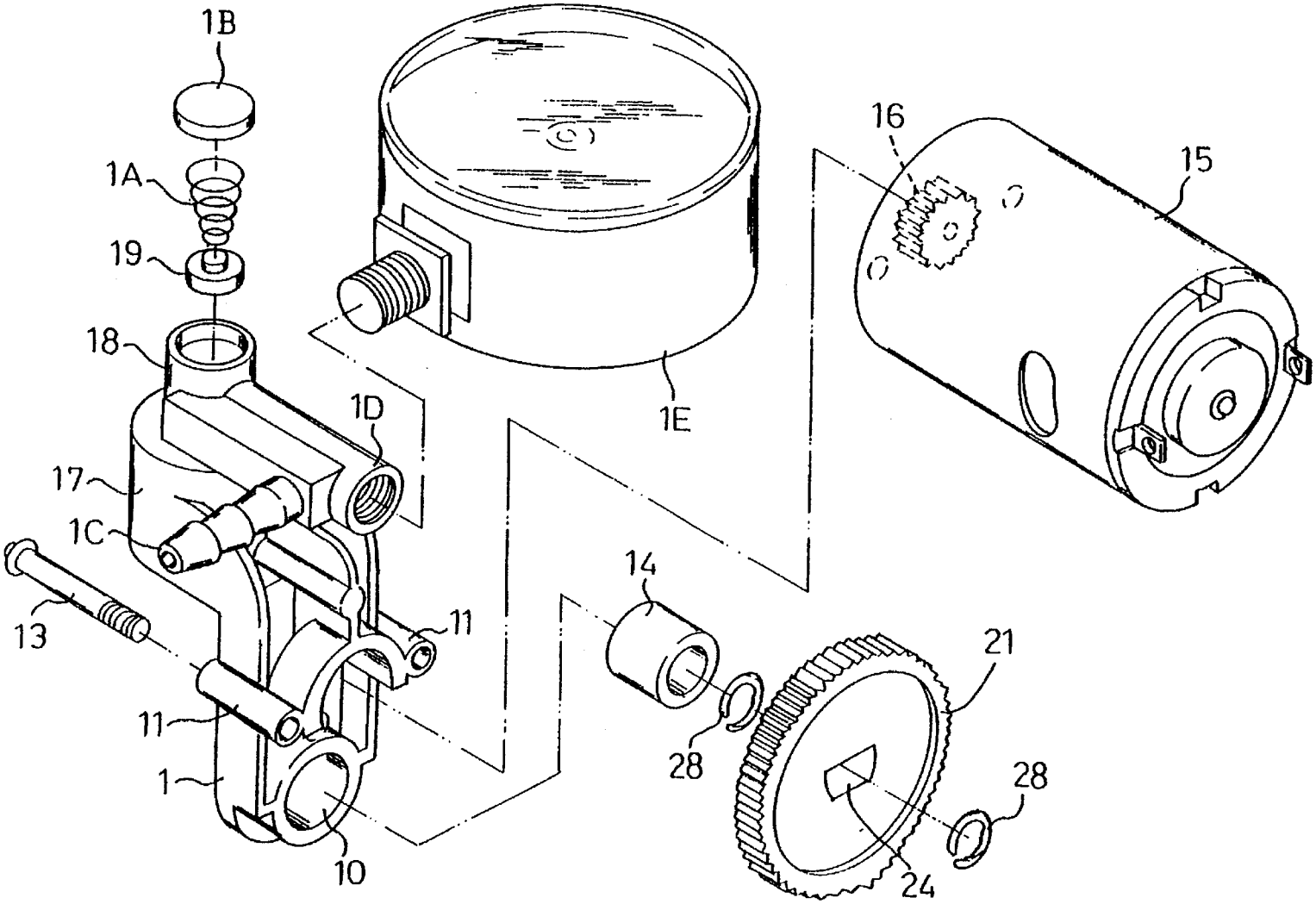
FIG. 1 is an exploded view of an air compressor according to the preferred embodiment of the present invention (Part I)

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
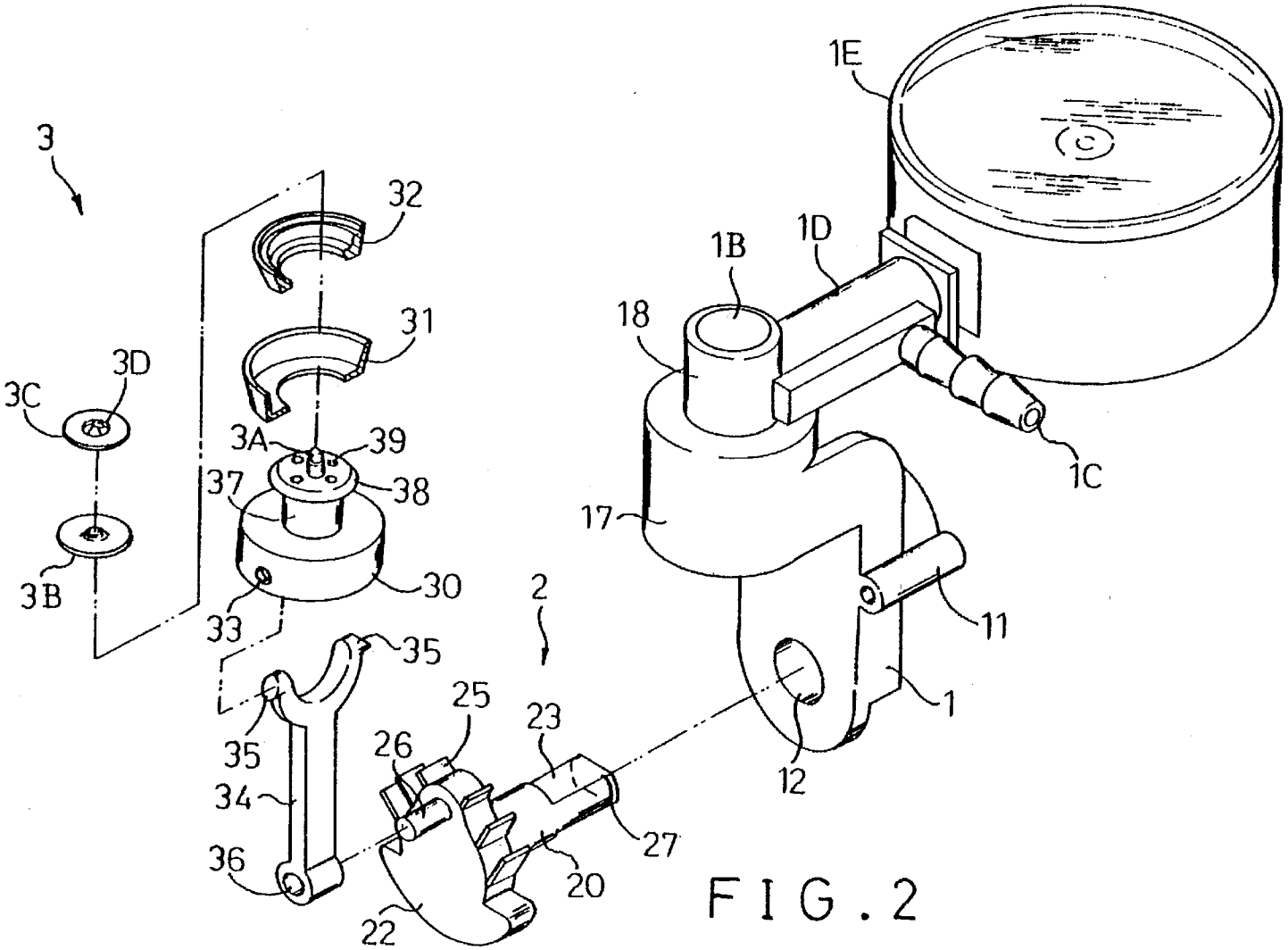
FIG. 2 is an exploded view of the compression mechanism of the air compressor of the preferred embodiment of the present invention (Part II)
Figure 3:
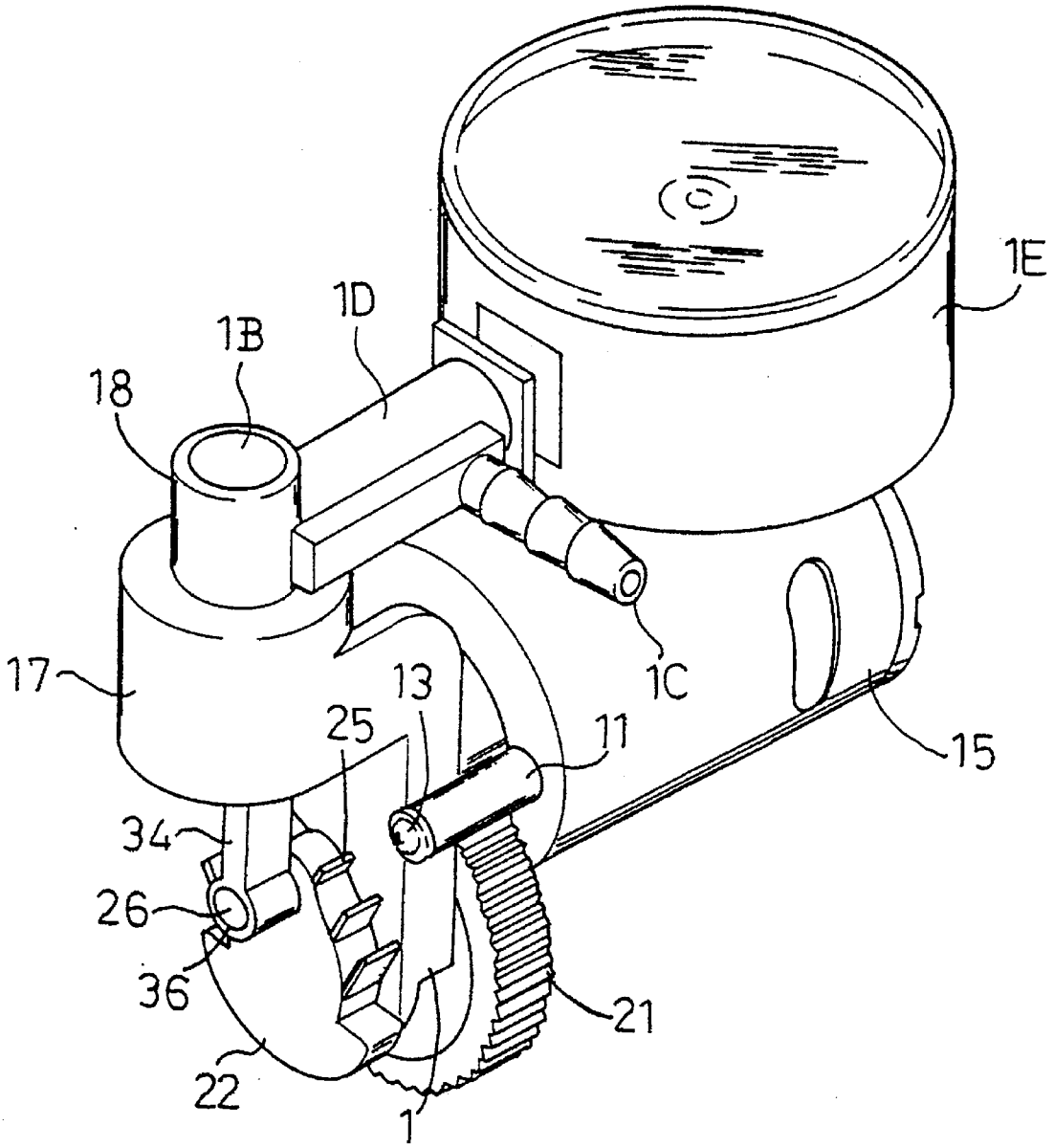
FIG. 3 is an elevational view of the air compressor of the preferred embodiment of the present invention.

Referring to FIGS. 1, 2, and 3, the mount, referenced by 1, comprises a pair of coupling tubes 11, and a vertical cylinder 17. A motor 15 which has a pinion 16 on the output shaft thereof is fastened to the coupling tubes 11 by screws 13. The cylinder 17 has an upright stub tube 18, which is sealed by a cap 1B, which holds a spring 1A inside the upright stub tube 18 and an exhaust valve block 19 at the bottom of the spring 17. A guide tube 1C and a coupling tube 1D are respectively and perpendicularly connected to the upright stub tube 18. The guide tube 1C is for output of compressed air. A pressure gauge 1E is connected to the coupling tube 1D to detect the value of air pressure. A transmission mechanism 2 is mounted on the mount 1 and controlled to reciprocate a compression mechanism 3 in the cylinder 17. The transmission mechanism 2 comprises 1 bushing 14 mounted in an axle hole 10 in the mount 1, a shaft 20 inserted through the bushing 14, a transmission gear 21 fastened to the shaft 20 at one end, and a counterweight 22 fastened to the shaft 20 at an opposite end and coupled to the compression mechanism 3. The transmission shaft has a flat section 23 at one end inserted through the bushing 14 and fitted into the center plug hole 24 of the transmission gear 21, and two mounting grooves 27 on which two clamps 28 are respectively mounted to secure the transmission gear 21 to the shaft 20. The counterweight 22 comprises a plurality of radiating fins 25 raised from the periphery, and a coupling rod 26 perpendicularly raised from one side at an eccentric location and coupled to the compression mechanism 3. The compression mechanism 3 is mounted inside the cylinder 17 and coupled to the coupling rod 26 through a link 34. The link 34 has a barrel 36 at one end coupled to the coupling rod 26 of the counterweight 22, and two reversed coupling rods 35 at an opposite end. The compression mechanism 3 comprises a base 30, a compressible conical piston 32, and a conical piston holder 31. The base 30 comprises two coupling holes 33 bilaterally disposed at the bottom and respectively coupled to the reversed coupling rods 35 of the link 34, a coupling bolt 37 raised from the top and having a head 38 at the top, a retainer rod 3A raised from the center of the head 38, a plurality of axial air holes 39 through the coupling bolt 37 and the base 30, a valve flap 3B slidably mounted around the retainer rod 3A, and a cap 3C having a coupling portion 3D at the center coupled to the retainer rod 3A above the valve flap 3B.

Figure 4B:
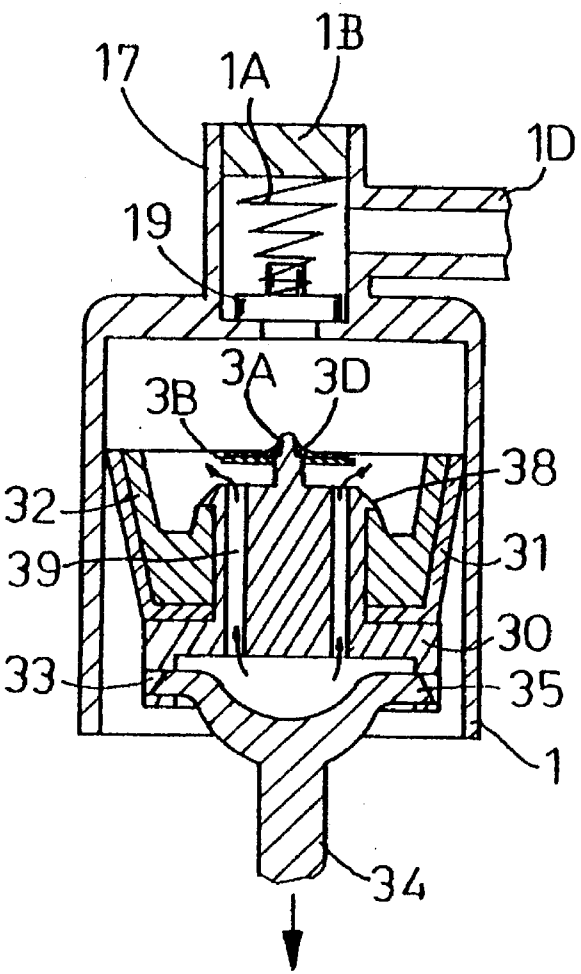
FIG. 4B is similar to FIG. 4A, but showing the down stroke of the compression mechanism.
Figure 4A:
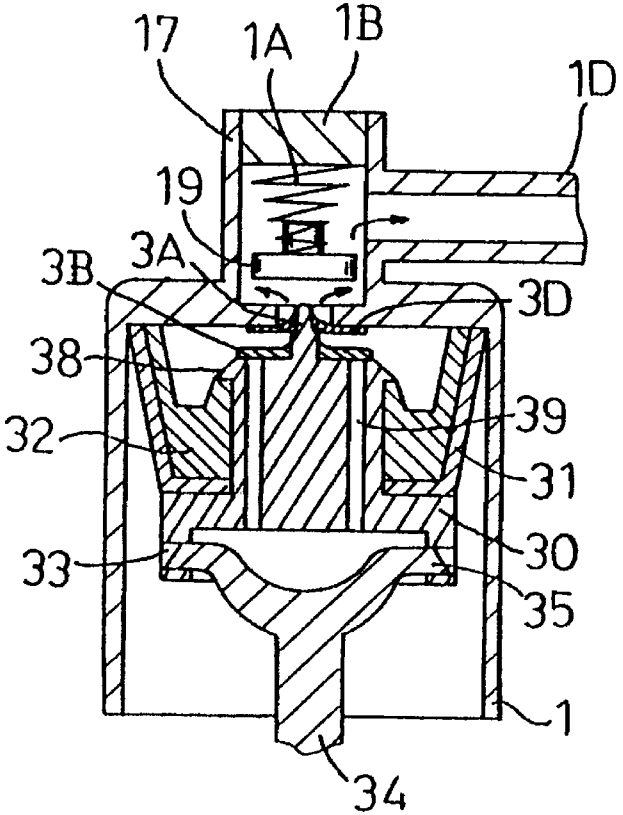
FIG. 4A is sectional view of the cylinder and the compression mechanism showing the up stroke of the compression mechanism according to the present invention.
Figure 5:
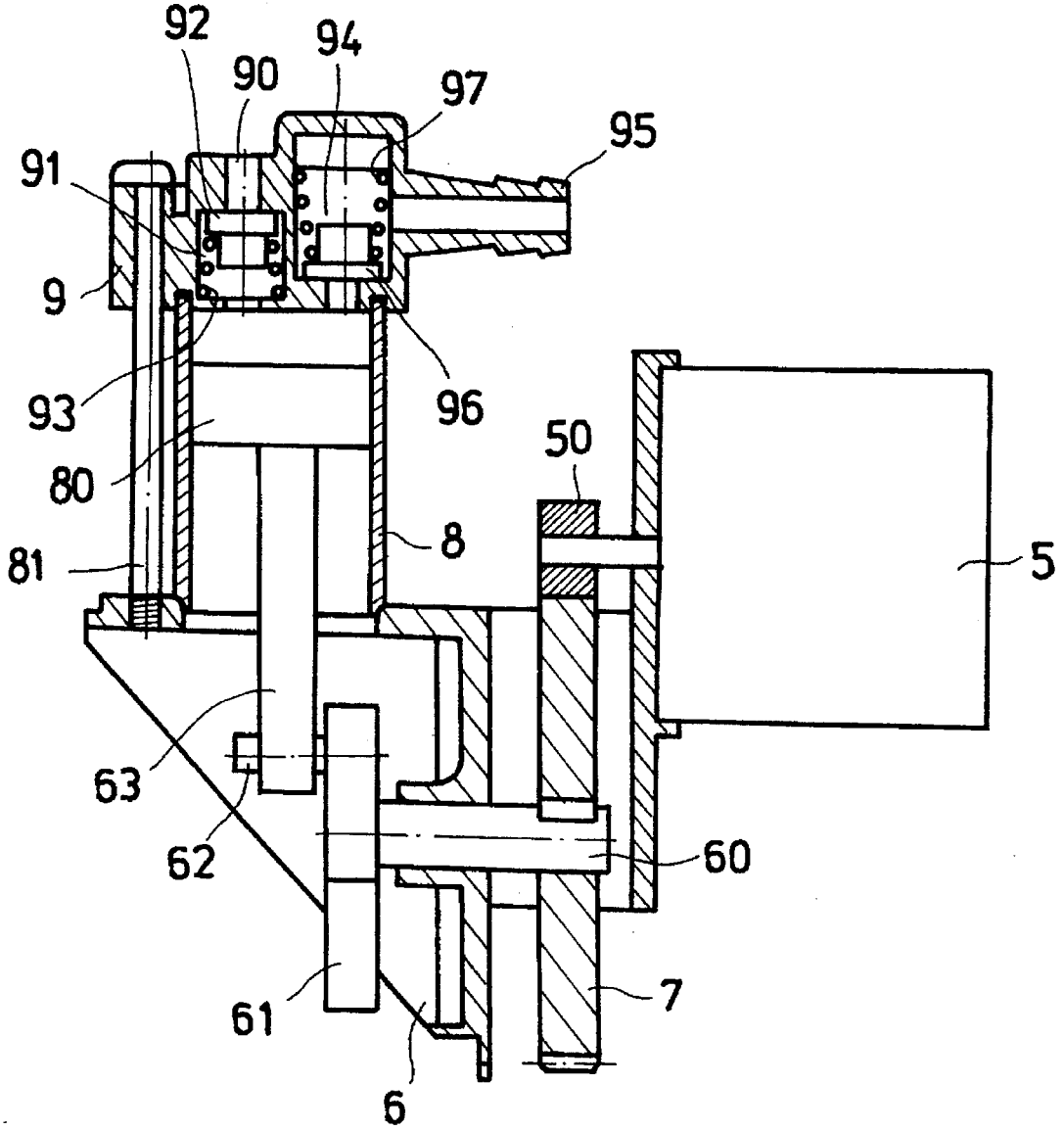
PRIOR ART FIG. 5
FIG. 5 is a sectional view of an air compressor according to the prior art.

Referring to FIGS. 4A and 4B, when the motor 15 is started to turn the pinion 16, the transmission gear 21 is turned by the pinion 16 to rotate the shaft 29 and the counterweight 22. Because the coupling rod 26 of the counterweight 22 is disposed at an eccentric location, when the counterweight 22 is turned with the shaft 20, the link 34 is driven by the coupling rod 26 of the counterweight 22 to reciprocate the base 30 of the compression mechanism 3, thereby causing the piston 32 and the piston holder 31 to be simultaneously reciprocated in the cylinder 17. When the piston 32 is moved downwards, outside air is guided into the inside space of the cylinder 17 through the axial air holes 39 (see FIG. 4B). On the contrary, when the piston 32 is moved upwards, the axial air holes 39 are blocked by the valve flap 3B, and the exhaust valve block 19 is forced upwards to open the air passage between the cylinder 17 and the guide tube 1C, permitting compressed air to flow out of the cylinder 17 through the guide tube 1C, and at the same time compressed air is partially guided to the pressure gauge 1E through the coupling tube 1D, causing the pressure gauge to indicate the value of compressed air.

The invention is naturally not limited in any sense to the particular features specified in the forgoing or to the details of the particular embodiment which has been chosen in order to illustrate the invention.

Consideration can he given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An air compressor comprising:

a mount having an upright cylinder at a top side thereof, an axle hole at a bottom side thereof, and a bushing mounted in said axle hole, said cylinder comprising an air intake hole, an air outlet hole, an exhaust valve block supported on a spring means to control said air outlet rod, a guide tube connected to said air outlet hole for exhaust of compressed air from said air outlet hole, and an air pressure gage for measuring the pressure of air passing from said air outlet hole to said guide tube;

a motor mounted on said mount, said motor having a motor shaft and a pinion fixedly mounted around said motor shaft;

a transmission mechanism mounted on said mount and driven by said motor, said transmission mechanism comprising a shaft inserted through the bushing in the axle hole of said mounting and having a flat section at one end, a transmission gear fixedly mounted around the flat section of said shaft and meshed with said pinion, and a counterweight fixedly mounted on said shaft at one end remote from said transmission gear, said counterweight having a plurality of radiating fins raised from the periphery and an eccentric coupling rod perpendicularly raised from one side;

a compression mechanism coupled to said transmission mechanism and reciprocated by it in said cylinder to compress air, permitting compressed air to be forced through said air outlet hole into said guide tube, said compression mechanism comprising a base, a compressible conical piston, and a compressible conical piston holder, said base comprising a coupling bolt raised from a top side thereof and having a head and adapted for holding said compressible conical piston holder and said compressible conical piston in said compressible conical piston holder, a retainer rod raised from the head of said coupling bolt, and a plurality of axial air holes made through said coupling bolt and said base and disposed in communication between said air intake hole and said air outlet hole; and a link coupled between the base of said compression mechanism and the coupling rod of the counterweight of said transmission mechanism;

wherein said mount and said cylinder are integrally molded together; the coupling bolt of the base of said transmission mechanism is inserted through a center hole in said compressible conical piston holder and a center hole in said compressible conical piston, having a head stopped above said compressible conical piston holder and said compressible conical piston; a valve flap is slidably mounted around said retainer rod which open the axial air holes of said compression mechanism during its down stroke and close the axial air holes of said compression mechanism during its upstroke; a cap is mounted on said retainer rod to limit upward movement of said valve flap relative to said retainer rod, said cap having a coupling portion at the center coupled to said retainer rod above said valve flap.

* * * * *